US006805178B2

(12) United States Patent
Miyazaki et al.

(10) Patent No.: US 6,805,178 B2
(45) Date of Patent: Oct. 19, 2004

(54) METALLIC CORD AND CARCASS PLY OF PNEUMATIC TIRE INCLUDING SAME

(75) Inventors: Shinichi Miyazaki, Kobe (JP); Kazumi Yamazaki, Kobe (JP); Osamu Toda, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 136 days.

(21) Appl. No.: 10/141,610

(22) Filed: May 9, 2002

(65) Prior Publication Data

US 2002/0185205 A1 Dec. 12, 2002

(30) Foreign Application Priority Data

May 9, 2001 (JP) ..... 2001-139065

(51) Int. Cl.[7] ..... B60C 9/00; B60C 9/04; D07B 1/06

(52) U.S. Cl. ..... 152/556; 57/206; 57/236; 57/311; 57/902; 152/451

(58) Field of Search ..... 152/451, 527, 152/556; 57/206, 236, 902, 311

(56) References Cited

U.S. PATENT DOCUMENTS 4,219,601 A * 8/1980 Inoue et al. ..... 152/527 X
5,135,039 A * 8/1992 Mizuta et al. ..... 152/451
6,089,293 A * 7/2000 Niderost ..... 57/311 X

FOREIGN PATENT DOCUMENTS

JP 10236108 A * 9/1998
JP 2000129583 A * 5/2000
JP 2000198311 A * 7/2000

* cited by examiner

*Primary Examiner*—Adrienne C. Johnstone
(74) *Attorney, Agent, or Firm*—Birch, Stewart, Kolasch & Birch, LLP

(57) ABSTRACT

A metallic cord is composed of metallic filaments gathered together, the metallic filaments include at least one patterned filament which is, before gathered together, two-dimensionally waved so as to have a wave form defined by plural kinds of cycles different from each other in respect of the wave length and/or wave height. A pneumatic tire includes the metallic cords as its carcass cords.

13 Claims, 2 Drawing Sheets

METALLIC CORD AND CARCASS PLY OF PNEUMATIC TIRE INCLUDING SAME

BACKGROUND OF THE INVENTION

The present invention relates to a metallic cord for rubber articles, more particularly to a cord structure capable of improving rubber penetration, flexibility and the like of the cord.

In recent years, in order to improve penetration of rubber into steel cords used to reinforce rubber articles such as pneumatic tires, there has been proposed a cord which is formed by twisting together steel filaments including filaments which are waved by a constant wave length and a constant wave height.

In such a cord, however, buckling is liable to occur on occasion and as a result the fatigue resistance and impact load resistance are decreased.

BRIEF SUMMARY OF THE INVENTION

It is therefore, an object of the present invention to provide a metallic cord in which the occurrence of buckling is effectively controlled to improve the fatigue resistance and impact load resistance as well as the rubber penetration.

According to one aspect of the present invention, a metallic cord is composed of metallic filaments gathered together, the total number of the metallic filaments is in a range of from two to twelve, and the metallic filaments include at least one patterned filament which is, before gathered together, two-dimensionally waved so as to have a wave form defined by plural kinds of cycles different from each other in respect of the wave length P and/or wave height H.

BREIF DESCRIPTION OF THE DRAWINGS

An embodiment of the present invention will now be described in detail in conjunction with the accompanying drawings.

DETAILED DESCRIPTION OF THE INVENTION

According to the present invention, a metallic cord 11 is composed of at least two metallic filaments 10 which are gathered together by twisting together or alternatively substantially without twisting together, and the metallic filaments 10 include at least one patterned filament 10A.

The patterned filament 10A is two-dimensionally waved before gathered to have a specific wave form.

Figure 2:
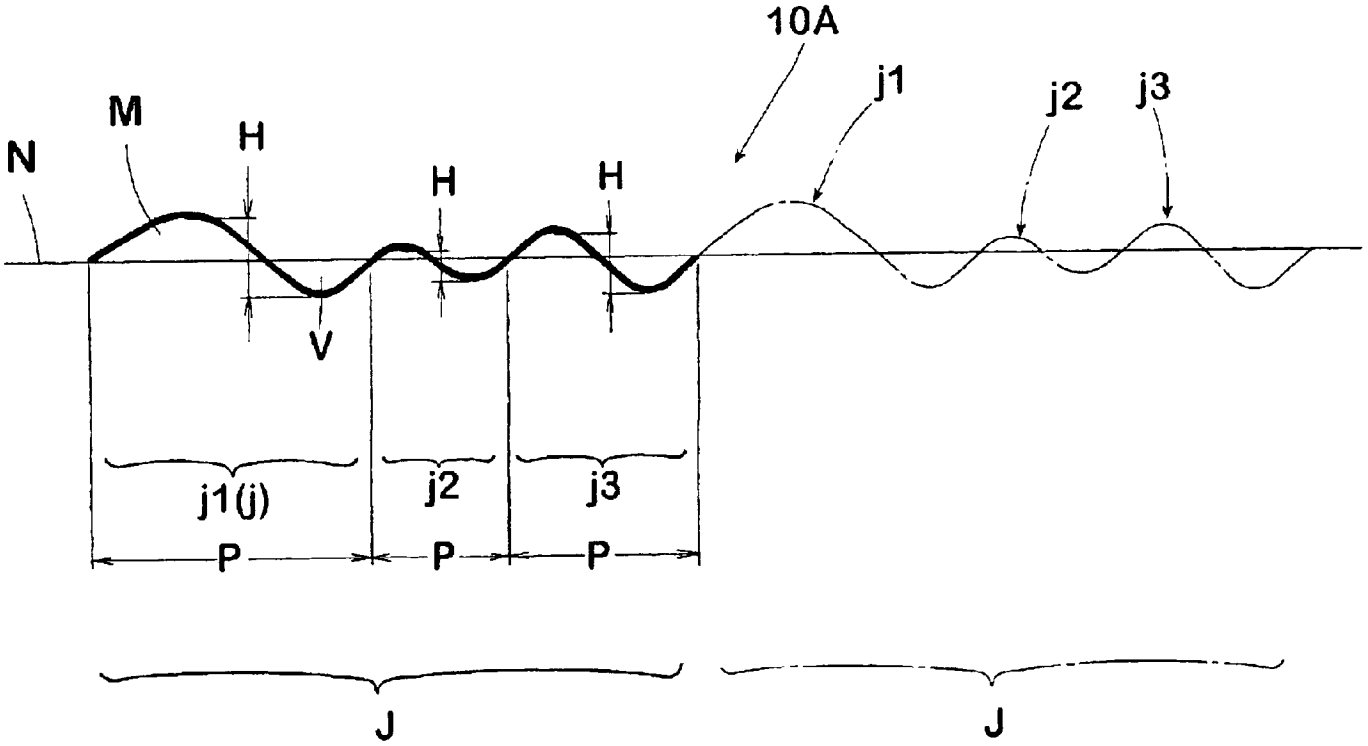
FIG. 2 is a diagram showing an example of the wave form of the patterned filament.

The wave form is made up of plural kinds of cycles (j) which are different in the wave length P and/or wave height H. Here, as shown in FIG. 2, each cycle (j) is defined by the adjacent mountain part (m) and valley part (v). The mountain part (m) and valley part (v) means a part on one side and a part on the other side of the base line N. The wave length P of one cycle (j) is defined as a length along the base line N. The wave height H of one cycle (j) is a distance between the peak of the mountain part (m) and the peak of the valley part (v) measured perpendicularly to the base line N. As far as the base line N is positioned between the peaks of the mountain parts (m) and the peaks of the valley parts (v), it may be eccentric towards the mountain parts (m) or the valley parts (v).

The plural kinds of cycles (j) may be arranged in an irregular sequence, but usually they are arranged in a regular sequence.

In case of a regular sequence, for example, the two-dimensional wave form of the patterned filament 10A can be made by repeating a unit (j) which is made up of plural kinds of cycles (j). More specifically, in the example of the wave form shown in FIG. 2, a unit (j) is made up of three kinds of cycles (j1, j2 and j3) which are different from each other in respect of both of the wave length P and wave height H, and the sequence in the unit (j) is (j1, j2, j3), thereby the sequence in the cord is (j1,j2,j3),(j1,j2,j3) - - - , namely, a regular sequence. In case of three kinds of cycles (j1, j2 and j3), other sequences in the cord are also possible by using other units (j) for example (j1,j2,j1,j3), (j2,j1,j2,j3) and the like.

The wave form may be a gentle curve such as a sine curve or a zigzag line of linear segments. Such a wave form can be provided on a straight filament by using a die like a gear which is provided with teeth varying their wave lengths and wave heights.

Figure 3:
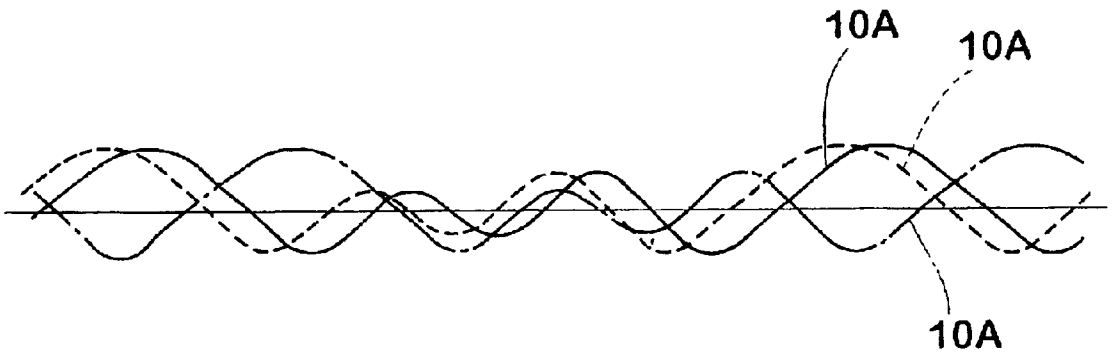
FIG. 3 is a diagram showing a phase shift in the wave forms in a patterned filament.

In case a metallic cord 10A includes a plurality of patterned filaments 10A, the patterned filaments 10A can be provided with the same two-dimensional wave form, but it is also possible to use two or more kinds of two-dimensional wave forms. When the same two-dimensional wave form is used, it is preferable that the patterned filaments 10A are shifted from each other in respect of the phase as shown in FIG. 3.

All or parts of the metallic filaments 10 can be the patterned filaments 10A. In case parts of the metallic filaments 10, the rest can be a straight filament and/or a conventional waved filament having a constant wave length and a constant wave height.

Figure 4:
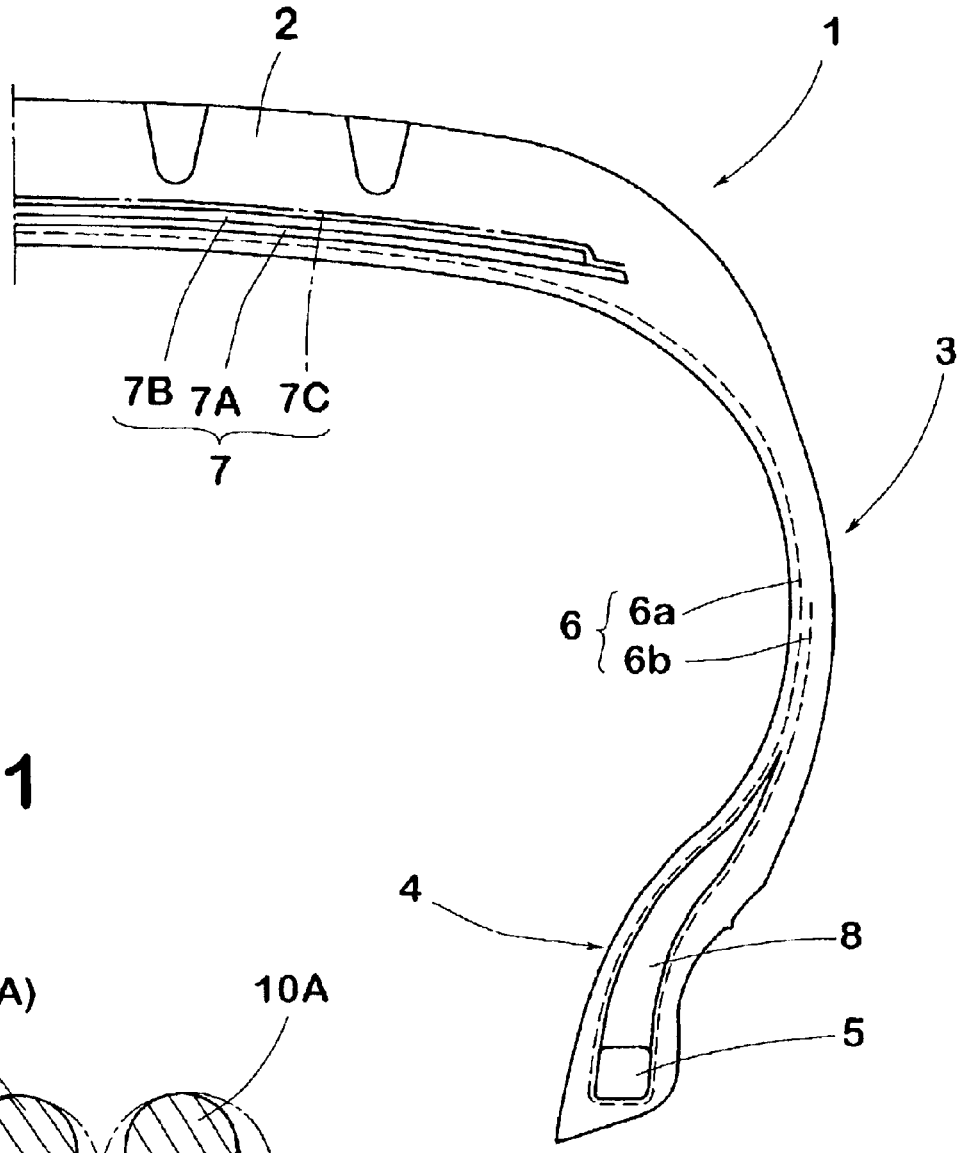
FIG. 4 is a cross sectional view of a pneumatic tire according to the present invention.

FIG. 4 shows a pneumatic tire 1 in which metallic cords 10 according to the present invention are used as carcass reinforcing cords.

The tire 1 in this embodiment is a radial tire for passenger cars. The tire 1 comprises a tread portion 2, a pair of sidewall portions 3, a pair of bead portions 4, a carcass 6 extending between the bead portions 4, and a tread reinforcing belt disposed radially outside the carcass 6.

The tread reinforcing belt comprises a breaker 7 and optionally a band 7C wound thereon. The beaker 7 comprises two cross plies 7A and 7B of parallel cords laid at an angle of from 15 to 35 degrees with respect to the tire circumferential direction. In case of heavy duty radial tire, the belt is usually composed of three or four plies. For the breaker cords, metallic cords are used in this example, but it is also possible to use high modulus organic fiber cords such as aromatic polyamide fiber cord and the like.

The carcass 6 comprises a ply 6A of cords arranged radially at an angle of from 75 to 90 degrees with respect to the circumferential direction and extending between the bead portions 4 through the tread portion 2 and sidewall portions 3 and turned up around the bead cores 5 from the inside to outside of the tire to form a pair of turnup portions 6*b* and a main portion 6*a* therebetween. In this embodiment, the carcass 6 consists of a single carcass ply 6A. Between the turnup portion 6*b* and main portion 6*a* in each bead portion 4, there is disposed a bead apex 8 which is made of hard rubber extending radially outwards from the bead core 5, tapering towards its radially outer end.

The carcass cords are the above-mentioned metallic cord 11. The diameters (d) of the metallic filaments 10 are in a range of from 0.15 to 0.30 mm. The total number (n) of the metallic filaments 10 in a cord is set in a range of from 2 to 12. The number of the patterned filament 10A is at least one, preferably at least two when the total number (n) is three or less (n=<3) and not less than 30% of the total number (n) when (n) is more than three (n>3). Preferably, the wave lengths P are set in a range of from 3 to 40 times the filament diameter (d). If less than 3 times, the strength of the filament is liable to decrease. If more than 40 times, the rubber penetration decreases. Preferably, the wave heights H are set in a range of from 0.2 to 3.0 times the filament diameter (d). If less than 0.2 times, the rubber penetration decreases. If more than 3.0 times, the strength of the filament decreases. The number of kinds of cycles (j) is set in a range of from 2 to 10.

In this embodiment, the metallic filaments 10 are twisted together into a cord, and all the metallic filaments 10 have the same diameter (d). All the metallic filaments 10 are patterned filaments 10A provided with the same wave form (sine curve) but they are shifted in the longitudinal direction.

In case the carcass consists of a single ply 6A of the metallic cords 11, the cord count is preferably set in a range of from 20 to 60/5 cm.

Comparison Tests

Figure 1:
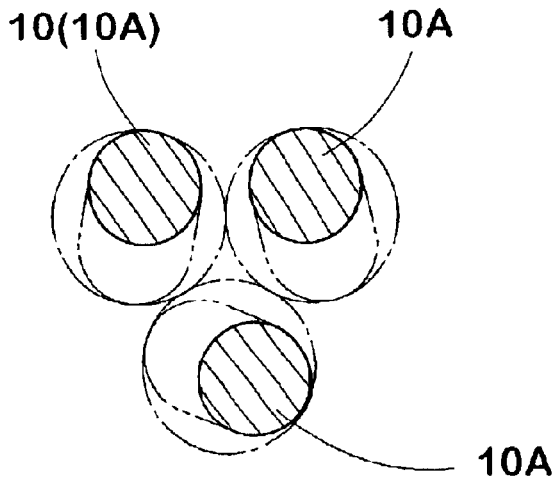
FIG. 1 is a schematic cross sectional view of a metallic cord according to the present invention which is made up of three patterned filaments.

Metallic cords were made and tested for rubber penetration and fatigue resistance, and using those metallic cords as carcass cords, radial tires of size 195/65R14 (rim size 6jj×14) for passenger cars having the structure shown in FIG. 1 were made and tested for ride comfort, steering stability and durability. Test results and specifications of the cords are shown in Table 1.

1) Rubber Penetration Test

The test cords were embedded in unvulcanized rubber in parallel with each other at regular intervals by disposing between two unvulcanized rubber seats and the rubber was vulcanized by heating. Then, from the vulcanized rubber strip, the test cords were took out and disassembled, and the length of a part into which the rubber was penetrated was measured along the cord length of about 10 cm to obtain the percentage of the measured length to the overall length of about 10 cm. In Table 1, the average of ten cords is shown. Thus, the larger the value, the better the penetration.

2) Fatigue Resistance Test

The fatigue test was conducted according to Japanese Industrial standard JIS-L1017 (Testing Method for chemical Fiber Tire cords, 3. Testing Method, 3.2 Fatigue strength, 3.2.1 Fatigue strength by compression-bending, (2) Method B (De Mattia Method)). Test samples were made out of the above-mentioned vulcanized rubber strip, and the samples were repeatedly bent until broken and the number of times was counted. In Table 1, the average of ten samples is indicated by an index based on Ref.1 being 100, wherein the larger the value, the higher the fatigue resistance.

3) Ride Comfort Test

A 2000 cc FF passenger car provided on four wheels with test tires (tire pressure 200 kPa) was run on dry rough roads (including asphalt road, stone-paved road and graveled road) and, based on harshness, damping, thrust-up, etc., a test driver evaluated ride comfort into ten ranks, wherein the higher the rank number, the better the ride comfort.

4) Steering Stability Test

The above-mentioned test car was run on a dry asphalt road in a test course and, based on handle response, rigidity, grip and the like, the test driver evaluated steering stability into ten ranks, wherein the higher the rank number, the better the steering stability.

5) Durability Test

Using a drum type durability tester, the test tires were run under the following accelerated condition: 150% of the maximum tire load specified in JIS, 80% of the normal pressure specified in JIS, and a speed of 80 km/h. After 15,000 km running, the tire was cut-open inspected for counting carcass cord breakage. Thus, the smaller the number, the better the durability (buckling).

TABLE 1

| Tire | Ref. | Ex. 1 | Ex. 2 |
|---|---|---|---|
| Carcass | | | |
| No. of ply | 1 | 1 | 1 |
| Cord | | | |
| Structure | 1 × 5 | 1 × 5 | 1 × 7 |
| Dia. d (mm) | 0.225 | 0.225 | 0.185 |
| Patterned filament | | | |
| No. of filament | 5 | 5 | 5 |
| No. of wave form | 1 | 1 | 1 |
| 2D Wave form | Sine | Sine | Sine |
| No. of cycle | 1 | 4 | 9 |
| Wave length P | 10.5 d | 10.5 d/30 d | 10.5 d/20 d/30 d |
| Wave height H | 1.5 d | 1.5 d/2.0 d | 1.0 d/1.5 d/2.0 d |
| Cord count/5 cm | 36 | 36 | 36 |
| Belt *1 | | | |
| Test Results | | | |
| Rubber penetration | 85 | 94 | 98 |
| Fatigue resistance | 100 | 106 | 105 |
| Tire performance | | | |
| Ride comfort | 5 | 6 | 7 |
| Steering stability | 5 | 7 | 6 |
| Durability | 12 | 0 | 1 |

*1 The belt was composed of two cross plies (breaker) of 1 × 3 × 0.38 steel cords laid at +20/−20 degrees with respect to the tire equator at a cord count of 24/5 cm.

Form the test results, it was confirmed that the metallic cord according to the present invention can be improved in both the rubber penetration and fatigue resistance, and by employing a carcass made of such metallic cords, the pneumatic tire can be improved in the ride comfort, steering stability and durability.

What is claimed is:

1. A metallic cord composed of metallic filaments gathered together, the metallic filaments including at least one patterned filament which is, before gathered together, two-dimensionally waved so as to have a wave form defined by plural kinds of cycles different from each other in respect of the wave length and/or wave height.

2. A metallic cord according to claim 1, wherein said at least one patterned filament is a plurality of patterned filaments having the same wave form.

3. A metallic cord according to claim 2, wherein the patterned filaments are shifted from each other in respect of the phase of the wave form.

4. A metallic cord according to claim 1, wherein said at least one patterned filament is a plurality of patterned filaments having different wave forms.

5. A metallic cord according to claim 1, wherein all the metallic filaments are the patterned filaments.

6. A metallic cord according to claim 1, wherein the metallic filaments include a filament which is straight before gathered together.

7. A metallic cord according to claim 1, wherein the metallic filaments include a filament which is, before gathered together, waved by a constant wave height and a constant wave length.

8. A metallic cord according to claim 1, wherein the total number of the metallic filaments is in a range of from 2 to 12.

9. A metallic cord according to claim 1, wherein the metallic filaments have a diameter (d) of from 0.15 to 0.30 mm.

10. A metallic cord according to claim 1, wherein the metallic filaments have a diameter (d) and the wave lengths are in a range of from 3 to 40 times the diameter (d).

11. A metallic cord according to claim 1, wherein the metallic filaments have a diameter (d) and the wave heights H are in a range of from 0.2 to 3.0 times the diameter (d).

12. A metallic cord according to claim 1, wherein the wave form is formed by repeating a unit made up of the plural kinds of cycles.

13. A pneumatic tire comprising a carcass extending between bead portions through a tread portion and sidewall portions, the carcass comprising a ply of metallic cords according to any of the preceding claims.

* * * * *